US010047977B2

(12) United States Patent
Hamasaki et al.

(10) Patent No.: US 10,047,977 B2
(45) Date of Patent: Aug. 14, 2018

(54) MONITORING METHOD AND COOLING SYSTEM

(71) Applicant: Sumitomo Heavy Industries, Ltd., Tokyo (JP)

(72) Inventors: Jyunya Hamasaki, Tokyo (JP); Toru Maruyama, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 870 days.

(21) Appl. No.: 14/462,987

(22) Filed: Aug. 19, 2014

(65) Prior Publication Data

US 2015/0047377 A1 Feb. 19, 2015

(30) Foreign Application Priority Data

Aug. 19, 2013 (JP) ..... 2013-169405

(51) Int. Cl.
*F25B 49/00* (2006.01)
*F25B 9/14* (2006.01)
*H01F 6/04* (2006.01)

(52) U.S. Cl.
CPC ..... *F25B 9/145* (2013.01); *F25B 49/005* (2013.01); *H01F 6/04* (2013.01); *F25B 49/00* (2013.01); *F25B 2309/1411* (2013.01); *F25B 2309/1427* (2013.01); *F25B 2309/1428* (2013.01); *F25B 2500/19* (2013.01); *F25B 2700/2115* (2013.01)

(58) Field of Classification Search
CPC ..... F24B 49/005; F24B 2500/19; F24B 9/002
See application file for complete search history.

(56) References Cited

U.S. PATENT DOCUMENTS 5,775,109 A 7/1998 Eacobacci, Jr. et al.
6,774,632 B2 8/2004 Kono
2003/0052681 A1* 3/2003 Kono ..... G01R 33/3815 324/318
2005/0210889 A1 9/2005 Arman et al.
2005/0247073 A1* 11/2005 Hikawa ..... F04B 49/065 62/228.1

(Continued)

FOREIGN PATENT DOCUMENTS

CN 101413746 A 4/2009
GB 2496573 A 5/2013

(Continued)

OTHER PUBLICATIONS

Extended search report issued in European Application No. 14181435.0, dated Jan. 13, 2015.

*Primary Examiner* — Ljiljana Ciric
*Assistant Examiner* — Alexis Cox
(74) *Attorney, Agent, or Firm* — Michael Best & Friedrich LLP

(57) ABSTRACT

A cooling system is provided with a refrigerator using helium gas, a compressor that compresses the helium gas returned from the refrigerator and supplies the gas to the refrigerator, and a control unit. The control unit includes a measurement acquisition unit that acquires measurements of a plurality of different parameters representing a status of the refrigerator, or the compressor, or both, and an analysis unit that conducts multivariate analysis of the measurements acquired by the measurement acquisition unit.

9 Claims, 9 Drawing Sheets

(56) References Cited

U.S. PATENT DOCUMENTS

| | | | | |
|---|---|---|---|---|
| 2006/0225433 | A1 | 10/2006 | Jammu et al. | |
| 2006/0255433 | A1* | 11/2006 | Xu | B32B 15/08 257/643 |
| 2008/0072608 | A1 | 3/2008 | Rampersad | |
| 2009/0096452 | A1* | 4/2009 | Gore | F25B 49/022 324/318 |
| 2010/0037639 | A1 | 2/2010 | Ogden et al. | |
| 2012/0271587 | A1* | 10/2012 | Shibuya | G05B 23/0229 702/127 |

FOREIGN PATENT DOCUMENTS

| | | | |
|---|---|---|---|
| JP | S63-140184 | U | 9/1988 |
| JP | H10-089787 | A | 4/1998 |
| JP | H11-173691 | A | 7/1999 |
| JP | 2001-336848 | A | 12/2001 |
| JP | 2003-056926 | A | 2/2003 |
| JP | 2003-079596 | A | 3/2003 |
| JP | 2003-324010 | A | 11/2003 |
| JP | 4749369 | B2 | 8/2011 |
| JP | 2011-190953 | A | 9/2011 |
| TW | 386107 | B | 4/2000 |

* cited by examiner

FIG. 5

| TIME | DISCHARGED GAS TEMPERATURE (°C) | COMPRESSOR INTERIOR TEMPERATURE (°C) | DISCHARGED COOLING WATER FLOW RATE (l/min) | DISCHARGED COOLING WATER TEMPERATURE (°C) | HIGH-PRESSURE SIDE PRESSURE (MPa) | INTERNAL HELIUM PRESSURE (MPa) | FIRST-STAGE TEMPERATURE (K) | SECOND-STAGE TEMPERATURE (K) | COMPRESSOR CURRENT (A) | COMPRESSOR POWER SUPPLY VOLTAGE (V) | COMPRESSOR POWER CONSUMPTION (kW) |
|---|---|---|---|---|---|---|---|---|---|---|---|
| May 25 2013 13:05 | 60 | 50 | 8 | 15 | 1.8 | 0.15 | 45 | 4.2 | 10 | 100 | 6 |
| | | | | | | | | | | | |

112

FIG.7

! ! PARAMETERS RELATED TO HEAT EXCHANGER COOLING WATER ARE SHOWING SIGNS OF ABNORMALITY

IF THE OPERATION IS CONTINUED, THE SYSTEM MAY STOP ABNORMALLY. MAINTENANCE IS RECOMMENDED.

OK

70

MONITORING METHOD AND COOLING SYSTEM

BACKGROUND OF THE INVENTION

1. Field of the Invention

The present invention relates to a method of monitoring a cooling system provided with a refrigerator and a compressor and also relates to a cooling system.

2. Description of the Related Art

Gifford-McMahon (GM) refrigerators, pulse tube refrigerators, Stirling refrigerators, and Solvay refrigerators are capable of cooling a target object to a temperature ranging from a low temperature of about 100 K (Kelvin) to an extremely low temperature of about 4 K. Such refrigerators are used to cool a superconducting magnet, a detector, a cryopump, etc. The refrigerator is provided with a compressor for compressing helium gas used as an operating gas in the refrigerator.

A refrigerator or a compressor needs periodic maintenance. Operators of an apparatus in which a refrigerator is used (e.g., a superconducting magnet system such as a magnetic resonance imaging (MRI) system) typically stop the operation of the refrigerator and the compressor in a well-prepared maintenance plan, considering impact on the MRI system operation.

Meanwhile, the operation of the refrigerator or the compressor may stop suddenly, aside from the planned stop for reasons of maintenance, (hereinafter, referred to as an abnormal stop or failure). In the event of an abnormal stop, liquid helium in the MRI system may evaporate and it may result in disadvantages, such as a quench of the superconducting coil or failure to perform a planned MRI examination.

As one means to overcome damage due to an abnormal stop, there is proposed a technology of predicting a failure of the refrigerator or the compressor.

This technology improves on the reliability of failure prediction techniques based on variation of a single parameter as taught in the related art. Using a single parameter is poor because the parameter may be significantly affected by variation in external variables such as the environment.

SUMMARY OF THE INVENTION

In this background, an embodiment of the present invention addresses a need to provide a technique of properly predicting an abnormal stop of a cooling system.

One embodiment of the present invention relates to a monitoring method for a cooling system including a refrigerator using gas and a compressor compressing the gas returned from the refrigerator and supplying the gas to the refrigerator. The method includes: acquiring measurements of a plurality of different parameters representing a status of the refrigerator, or the compressor, or both; and conducting multivariate analysis of the acquired measurements.

Another embodiment of the present invention relates to a cooling system including: a refrigerator using gas; a compressor that compresses the gas returned from the refrigerator and supply the gas to the refrigerator; and a control unit. The control unit includes: a measurement acquisition unit that acquires measurements of a plurality of different parameters representing a status of the refrigerator, or the compressor, or both; and an analysis unit that conducts multivariate analysis of the measurements acquired by the measurement acquisition unit.

Optional combinations of the aforementioned constituting elements, and implementations of the invention in the form of methods, apparatuses, systems, computer programs, data structures, and recording mediums may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5 shows an exemplary data structure in a standard data storage unit of FIG. 4;

FIG. 7 shows a typical failure alert screen;

DETAILED DESCRIPTION OF THE INVENTION

Figure 1:
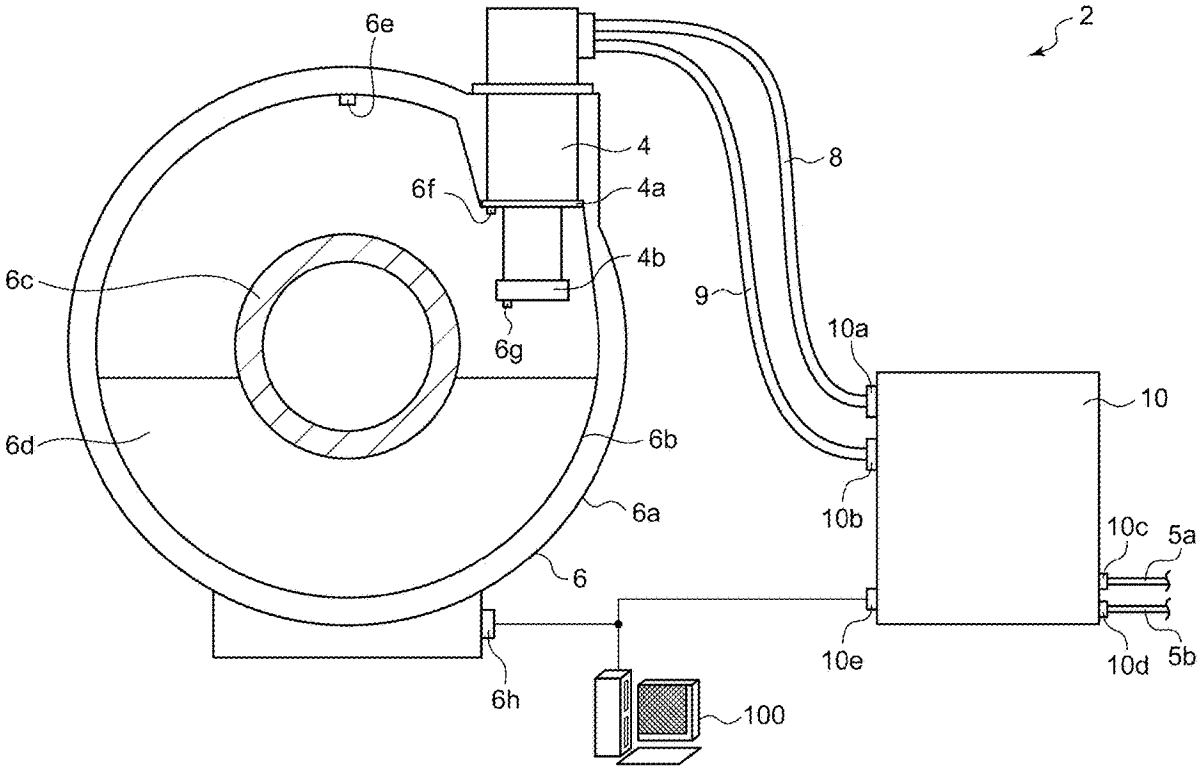
FIG. 1 is a schematic diagram showing a configuration of an MRI system provided with a cooling system according to an embodiment.

The invention will now be described by reference to the preferred embodiments. This does not intend to limit the scope of the present invention, but to exemplify the invention.

Like numerals in the drawings represent like constituting elements, members or processes so that the description may be omitted as appropriate. For ease of understanding, the dimension of the members in the drawings may be shown on an enlarged or reduced scale as appropriate. Some of the members that may be less important for the purpose of describing the embodiments may not be shown in the drawings.

In an ordinary cooling system that includes a refrigerator and a compressor, pressure switches (or pressure sensors) and temperature switches (or temperature sensors) are mounted at selected locations. Such a cooling system is provided with the function of comparing "a value occurring at a point of measurement (hereinafter, PV)" during the operation and "a preset value (hereinafter, SV)", and determining that the operation is normal if PV<SV. Otherwise, the system determines that the operation is abnormal and stops the operation immediately.

In one approach of failure prediction technique, a numerical value for an alert (hereinafter WV) lower than SV is defined such that WV<SV. The operation is determined to be normal if PV<WV<SV and abnormal if WV<SV<PV. An alert is generated if WV<PV<SV. This kind of approach is devised by us for the purpose of discussion. This would appear to be useful and allow efficient determination in some cases.

However, mere comparison of values of two parameters (e.g., temperature/pressure or temperature/flow rate) in a cooling system (e.g., determination of PV1<SV1 on one parameter and PV2<SV2 on another) may not yield proper judgment.

For example, we will consider prediction of a failure (malfunction) in which compressor pipes for cooling water are clogged due to collection of foreign materials or impurities, resulting in a gradual drop in the flow rate of cooling water. By way of example, the flow rate of cooling water defined as being normal in a specification is 4 l/min to 9 l/min and the initial flow rate of cooling water in a given system is 8 l/min. A failure prediction in an ordinary system may be achieved by determining that the operation is abnormal when the flow rate gradually drops until it reaches 4 l/min, which is defined as the minimum flow rate of cooling water in the specification, or below, and setting off an alert when the flow rate reaches 5 l/min, which precedes 4 l/min in time.

It would appear that a failure prediction is properly achieved in this way. Upon further review, however, the range between 4 l/min-5 l/min produces an alert but is defined as being normal according to the specification. Therefore, the operator may be confused. Additionally, if the initial flow rate is only as much as 5 l/min, an alert will be issued ceaselessly. In other words, according to the above described approach, it cannot be known whether the initial flow rate of 8 l/min drops to 5 l/min due to clogging, a drop in flow from the supply facility from 8 l/min to 5 l/min, or perhaps the system is operated at 5 l/min from the beginning. Situations that set off an alert include those that cannot be said to be a failure. Thus, it is difficult according to the above described approach whether an alert is a sign of impending failure or not. Further, the flow rate of 5 l/min may be inside or outside the scope defined by the specification as being normal, depending on the temperature of the cooling water. It is therefore difficult to clearly distinguish between normal, nearly abnormal, or abnormal merely by monitoring the flow rate of cooling water, thus the likelihood of wrong detection of an abnormality is increased.

In contrast, according to the method of monitoring a cooling system according to an embodiment of the present invention, measurement data for a plurality of different parameters representing the status of a cooling system are subject to multivariate analysis, and failure prediction of the cooling system is performed based on the result of this analysis. This increases the prevision of prediction as compared to the related-art failure prediction based on a single variable and reduces the likelihood of wrong detection of an abnormality.

FIG. 1 is a schematic diagram showing the configuration of an MRI system 2 provided with the cooling system according to the embodiment. The MRI system 2 is provided with a gantry or MRI cryostat 6 having a substantially doughnut shape and configured to allow passage of a subject of examination through the center, a GM refrigerator 4 for cooling the interior of the MRI cryostat 6, a compressor 10 coupled to the GM refrigerator 4 via two flexible pipes 8, 9, and a monitoring terminal 100. The GM refrigerator 4, the compressor 10, and the two flexible pipes 8, 9 constitute a cooling system according to the embodiment that cools a subject of cooling (in this case, the interior of the MRI cryostat 6). The cooling system is used to cool a superconducting coil 6*c* of the MRI system 2.

The MRI cryostat 6 includes a housing 6*a*, a shield 6*b*, and a superconducting coil 6*c*. The superconducting coil 6*c* is formed by a wire member of a material exhibiting superconductivity at a liquid helium temperature (about 4.2 K). The space between the housing 6*a* and the shield 6*b* is evacuated in order to suppress heat conduction. The shield 6*b* surrounds the superconducting coil 6*c*. The space between the shield 6*b* and the superconducting coil 6*c* is a liquid helium bath 6*d*. While the MRI system 2 is running, liquid helium is stored in the liquid helium bath 6*d*.

The GM refrigerator 4 is a known two-stage GM refrigerator and may be configured by using the technology described in JP2011-190953 filed by the applicant previously. The first cooling stage 4*a* of the cold head of the GM refrigerator 4 is mechanically coupled to the shield 6*b*, and the second cooling stage 4*b* is exposed above the liquid surface of the liquid helium in the liquid helium bath 6*d*, i.e., exposed in the gas above the liquid helium.

While the MRI system 2 is running, the temperature of the housing 6*a* is at ambient temperature, i.e., about 300 K (Kelvin). The temperature of the shield 6*b* is maintained at 40 K-50 K by the cooling of the GM refrigerator 4. The second cooling stage 4*b* maintains the pressure in the liquid helium bath 6*d* at a prescribed level or below by recondensing (liquefying) evaporating helium.

A pressure sensor 6*e* for measuring the pressure in the liquid helium bath 6*d* (hereinafter, internal helium pressure) is mounted on the top of the liquid helium bath 6*d*. A first-stage temperature sensor 6*f* for measuring the temperature of the first cooling stage 4*a* (hereinafter, the first stage temperature) is mounted on the first cooling stage 4*a*. The first-stage temperature represents the temperature of the shield 6*b*. A second-stage temperature sensor 6*g* for measuring the temperature of the second cooling stage 4*b* (hereinafter, the second-stage temperature) is mounted on the second cooling stage 4*b*.

The high-pressure flexible pipe 8 supplies a high-pressure operating gas (e.g., helium gas) from the compressor 10 to the GM refrigerator 4. The low-pressure flexible pipe 9 supplies a low-pressure helium gas from the GM refrigerator 4 to the compressor 10.

The compressor 10 compresses the helium gas returning from the GM refrigerator 4 via the low-pressure flexible pipe 9 and supplies the compressed helium gas to the GM refrigerator 4 via the high-pressure flexible pipe 8. The compressor 10 is provided with a high-pressure port 10*a* coupled to the high-pressure flexible pipe 8, a low-pressure port 10*b* coupled to the low-pressure flexible pipe 9, and a cooling water inlet port 10*c* for receiving cooling liquid such as cooling water or non-freezing liquid from a cooling water circulating device (not shown) outside the compressor 10, and a cooling water outlet port 10*d* for discharging cooling water from the compressor 10. The ports are mounted on the housing of the compressor 10.

A cooling water supplying pipe 5*a* is coupled to the cooling water inlet port 10*c*. Cooling water of low temperature and high pressure from the cooling water circulating device flows through the cooling water supplying pipe 5*a* toward the compressor 10 and enters the compressor 10, passing through the cooling water inlet port 10*c*. A cooling water return pipe 5*b* is coupled to the cooling water outlet port 10*d*. Cooling water of high temperature and low pressure from the interior of the compressor 10 passes through the cooling water outlet port 10*d* and flows in the cooling water return pipe 5*b* toward the cooling water circulating device.

A first communication port 6*h* of the MRI cryostat 6, a second communication port 10*e* of the compressor 10, and a communication port of the monitoring terminal 100 are connected to each other via a wire or wireless network. Measurement information in the GM refrigerator 4 such as the first stage temperature and the second stage temperature, and measurement information in the MRI system 2 such as the internal helium pressure and the value of the current flowing through the superconducting coil 6*c* are transmitted from the first communication port 6*h* to the monitoring terminal 100 in the form of an electrical signal.

The monitoring terminal 100 displays the status of the MRI system 2 based on the received information on a display. The operator controls on and off and the operation of the MRI cryostat 6 and the compressor 10 via the monitoring terminal 100.

Figure 2:
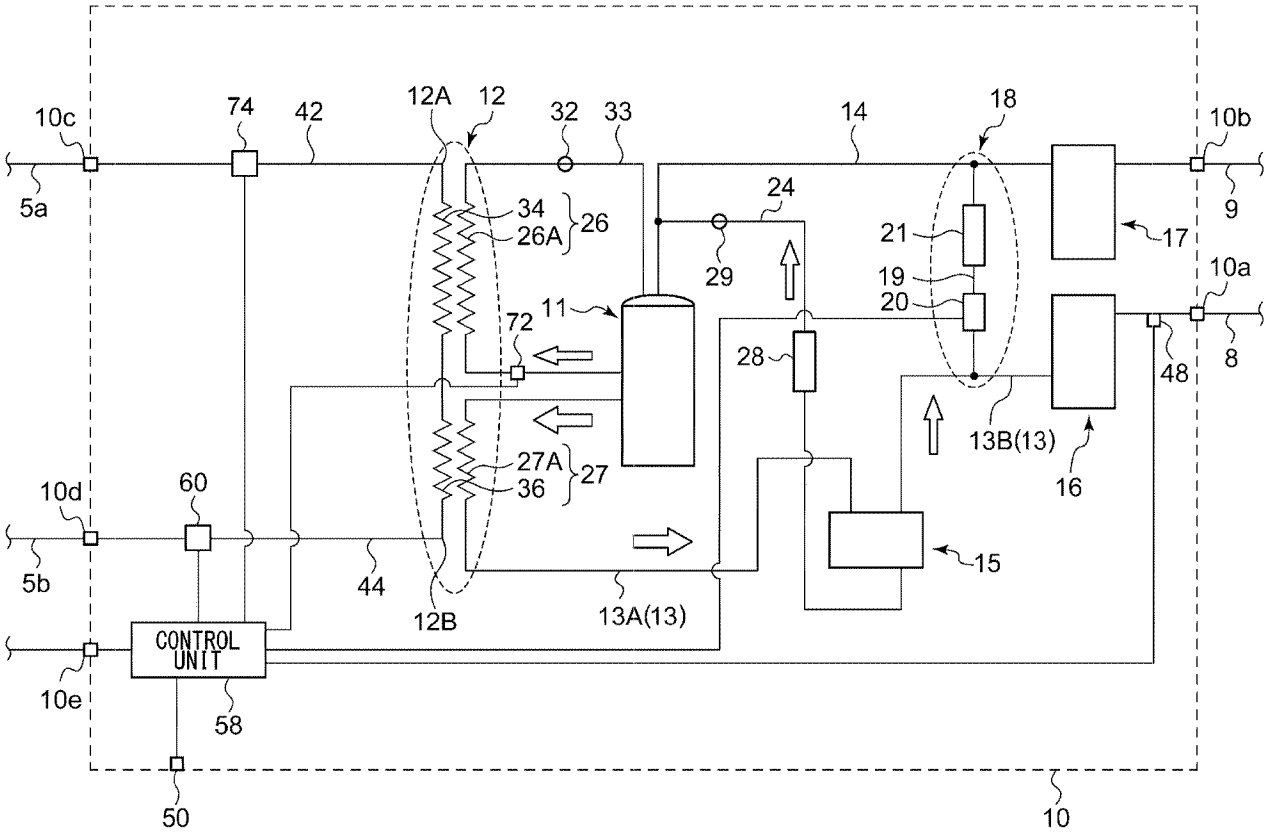
FIG. 2 shows a configuration of the compressor of FIG. 1.

FIG. 2 shows the configuration of the compressor 10. The compressor 10 includes a compression capsule 11, a water-cooled heat exchanger 12, a high-pressure side pipe 13, a low-pressure side pipe 14, an oil separator 15, an adsorber 16, a storage tank 17, a bypass mechanism 18, and a control unit 58. The compressor 10 pressurizes low-pressure helium gas returned from the GM refrigerator 4 via the low-pressure flexible pipe 9, using the compression capsule 11, and supplies the gas to the GM refrigerator 4 again via the high-pressure flexible pipe 8.

The helium gas returned from the GM refrigerator 4 flows into the storage tank 17 via the low-pressure flexible pipe 9. The storage tank 17 removes pulsation accompanying the returning helium gas. Because the storage tank 17 has a relatively large volume, the pulsation can be dampened or removed by introducing the helium gas into the storage tank 17.

The helium gas having the pulsation dampened or removed in the storage tank 17 is guided to the low-pressure side pipe 14. The low-pressure side pipe 14 is coupled to the compression capsule 11. Therefore, the helium gas having the pulsation dampened or removed in the storage tank 17 is supplied to the compression capsule 11.

The compression capsule 11 is a scroll pump or a rotary pump, for example, and compresses and pressurizes the helium gas in the low-pressure side pipe 14. The compression capsule 11 delivers the helium gas with a raised pressure to the high-pressure side pipe 13A (13). The helium gas is pressurized in the compression capsule 11 and delivered to the high-pressure side pipe 13A (13) such that oil in the compression capsule 11 is mixed in the gas in a small amount.

The compression capsule 11 is configured to be cooled by using oil. Therefore, an oil cooling pipe 33 for circulating oil is coupled to an oil heat exchanger 26 included in the water-cooled heat exchanger 12. Further, an orifice 32 for controlling the flow rate of oil flowing inside is provided in the oil cooling pipe 33.

The water-cooled heat exchanger 12 exchanges heat to discharge heat generated in compressing the helium gas in the compression capsule 11 (hereinafter, referred to as compression heat) outside the compressor 10. The water-cooled heat exchanger 12 is provided with an oil heat exchanger 26 for cooling the oil flowing in the oil cooling pipe 33 and a gas heat exchanger 27 for cooling the pressurized helium gas.

The oil heat exchanger 26 is provided with a part 26A of the oil cooling pipe 33 in which oil flows and a first cooling water pipe 34 in which cooling water flows. The oil heat exchanger 26 is configured such that heat is exchanged between the part 26A and the first cooling water pipe 34. The oil discharged from the compression capsule 11 to the oil cooling pipe 33 is at a high temperature due to the compression heat. As the high-temperature oil passes through the oil heat exchanger 26, the heat of the oil is transferred to the cooling water by heat exchange so that the temperature of the oil exiting the oil heat exchanger 26 becomes lower than the temperature of the oil entering the oil heat exchanger 26. In other words, the compression heat is transferred to the cooling water via the oil flowing in the oil cooling pipe 33 and discharged outside.

The gas heat exchanger 27 is provided with a part 27A of the high-pressure side pipe 13A in which high-pressure helium gas flows and a second cooling water pipe 36 in which the cooling water flows. In the gas heat exchanger 27, as in the oil heat exchanger 26, the compression heat is transferred to the cooling water via the helium gas flowing in the high-pressure side pipe 13A (13) and discharged outside.

The first cooling water pipe 34 and the second cooling water pipe 36 are coupled in series. An end of the first cooling water pipe 34 functions as a cooling water receiving port 12A of the water-cooled heat exchanger 12. The other end of the first cooling water pipe 34 is coupled to one end of the second cooling water pipe 36. The other end of the second cooling water pipe 36 functions as a cooling water discharge port 12B of the water-cooled heat exchanger 12.

The compressor 10 is provided with a first pipe 42 coupling the cooling water inlet port 10*c* to the cooling water receiving port 12A, and a second pipe 44 coupling the cooling water outlet port 10*d* to the cooling water discharge port 12B.

A measuring unit 60 is provided in the second pipe 44. The measuring unit 60 measures the flow rate (hereinafter, referred to as discharged cooling water flow rate) and temperature (hereinafter, referred to as discharged cooling water temperature) of cooling water discharged from the cooling water outlet port 10*d* and reports the measurements to the control unit 58.

The helium gas pressurized in the compression capsule 11 and cooled by the gas heat exchanger 27 is supplied to the oil separator 15 via the high-pressure side pipe 13A (13). The oil separator 15 separates oil contained in the helium gas and removes impurities and dust contained in the oil.

The helium gas having the oil removed by the oil separator 15 is delivered to the adsorber 16 via the high-pressure side pipe 13B (13). The adsorber 16 is specifically designed to remove the residual oil contained in the helium gas. Once the residual oil is removed in the adsorber 16, the helium gas is guided to the high-pressure flexible pipe 8 and supplied thereby to the GM refrigerator 4.

A discharged gas temperature sensor 48 for measuring the temperature of the helium gas exiting the compressor 10 (hereinafter, referred to as discharged gas temperature) is provided in a pipe between the adsorber 16 and the high-pressure port 10*a*. The discharged gas temperature sensor 48 measures the temperature of the discharged gas and reports the measurement to the control unit 58.

The bypass mechanism 18 is provided with a bypass pipe 19, a high-pressure side pressure detector 20, and a bypass valve 21. The bypass pipe 19 communicates the high-pressure side pipe 13B with the low-pressure side pipe 14. The high-pressure side pressure detector 20 detects the pressure of the helium gas in the high-pressure side pipe 13B (hereinafter, referred to as high-pressure side pressure) and reports the pressure to the control unit 58. The bypass valve 21 is an electric-powered valve device to open and close the bypass pipe 19. The bypass valve 21 is configured as a normally closed valve to be controlled and driven by the high-pressure side pressure detector 20.

More specifically, the bypass valve 21 is configured to be driven by the high-pressure side pressure detector 20 so as to be opened, when the high-pressure side pressure detector 20 detects that the pressure of the helium gas in a path between the oil separator 15 and the adsorber 16, i.e., the high-pressure side pressure, is a prescribed pressure or higher. This reduces the likelihood that supply gas at a prescribed pressure or higher is supplied to the GM refrigerator 4.

The high-pressure side of an oil return pipe 24 is coupled to the oil separator 15 and the low-pressure side thereof is coupled to the low-pressure side pipe 14. In the middle of the oil return pipe 24 are provided a filter 28 for removing dust contained in the oil separated by the oil separator 15 and an orifice 29 for controlling the amount of oil returned.

Inside the housing of the compressor 10 is provided a compressor interior temperature sensor 50 for measuring the temperature inside the compressor 10 (hereinafter, referred to as compressor interior temperature). The compressor interior temperature sensor 50 measures the compressor interior temperature and reports the measurement to the control unit 58.

The control unit 58 predicts an abnormal stop of the compressor 10 or the GM refrigerator 4 by monitoring the status of the cooling system and provides a failure alert based on the result of prediction to the monitoring terminal 100 via a network. The control unit 58 conducts multivariate analysis of measurement data for a plurality of different parameters representing the status of the cooling system and predicts an abnormal stop based on the result.

More specifically, the Mahalanobis-Taguchi (MT) System is employed as multivariate analysis executed by the control unit 58. The MT system hypothesizes that normal status and average status are similar in their behavior. A normal pattern or tendency is defined in accordance with this hypothesis. Meanwhile, because it is impossible to know what happens in an abnormal status or non-average status, the behavior of such status is uncertain so that it is impossible to define a pattern or tendency. This nature is taken advantage of such that a normal pattern as defined is compared with the current status and discrimination of whether the current status is normal or abnormal is made by referring to the magnitude of displacement between the normal pattern and the current status. The MT system includes the one-side T method, both-side T method, multi-T method, and MT method.

Figure 3:
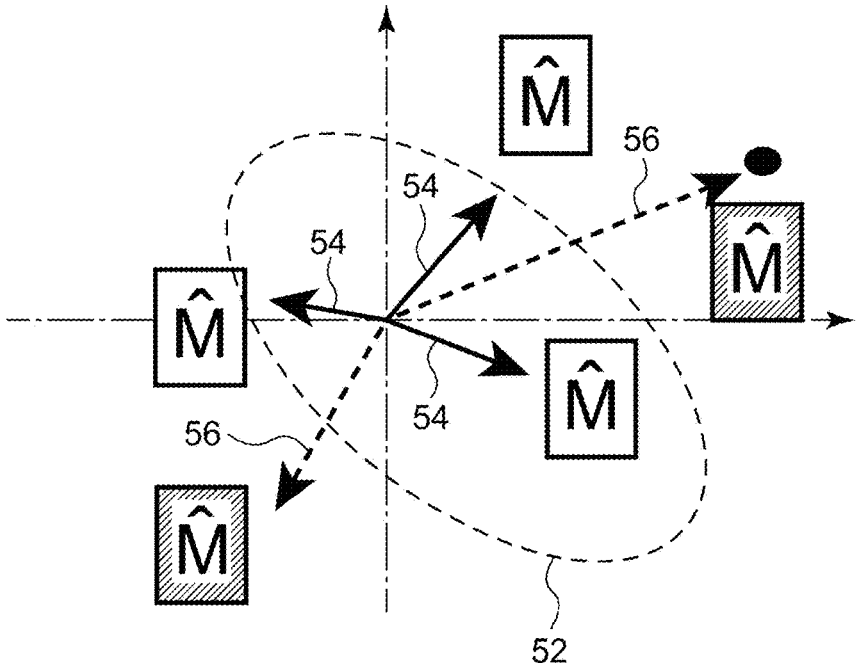
FIG. 3 is a schematic diagram showing the concept of the MT system.

FIG. 3 is a schematic diagram showing the concept of the MT system. The MT system is designed to define a boundary line in a multi-dimensional space by collecting a relatively large amount of data for normal status and average status. By using a "distance of displacement" from the pattern of normal status thus defined, a determination can be made as to how close the current status is to abnormal. More specifically, a boundary 52 is defined from a set of normal status indicators 54. A status indicator 56 that is deviated from the boundary 52 is determined to be abnormal or nearly abnormal.

Figure 4:
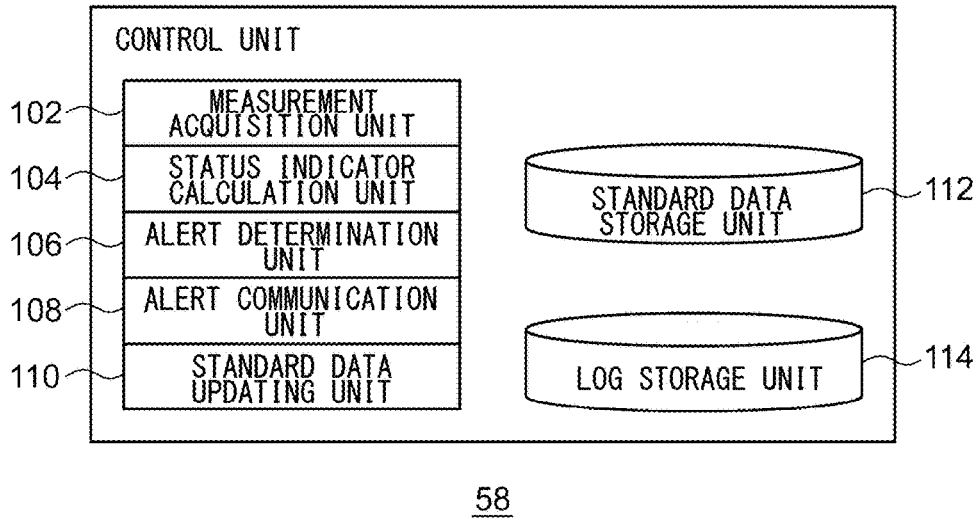
FIG. 4 is a block diagram showing a function and configuration of the control unit of FIG. 2.

FIG. 4 is a block diagram showing the function and configuration of the control unit 58. The blocks depicted here are implemented in hardware such as devices or mechanical components like a CPU of a computer, and in software such as a computer program etc. FIG. 4 depicts functional blocks implemented by the cooperation of these elements. Therefore, it will be understood by those skilled in the art that the functional blocks may be implemented in a variety of manners by a combination of hardware and software.

The control unit 58 includes a measurement acquisition unit 102, an analysis unit or a status indicator calculation unit 104, an alert determination unit 106, an alert communication unit 108, a standard data updating unit 110, a standard data storage unit 112, a log storage unit 114.

The standard data storage unit 112 stores measurements of parameters occurring when the status of the cooling system is normal or average. The standard data storage unit 112 is pre-installed in the compressor 10 before shipping and is updated as necessary by the standard data updating unit 110 described later. The manufacturer of the cooling system may acquire data that should be stored in the standard data storage unit 112 while the cooling system is being operated on a trial basis before shipping. Alternatively, in case a compressor of the same type as the compressor 10 is being in use in another system, the associated data may be acquired and used for storage in the standard data storage unit 112.

FIG. 5 shows an exemplary data structure in the standard data storage unit 112. The standard data storage unit 112 stores time, discharged gas temperature, compressor interior temperature, discharged cooling water flow rate, discharged cooling water temperature, high-pressure side pressure, internal helium pressure, first-stage temperature, second-stage temperature, electric current supplied from a power supply to the compressor 10, voltage applied from the power supply to the compressor 10, and power consumption in the compressor 10, associating the data with each other.

Referring back to FIG. 4, the measurement acquisition unit 102 periodically acquires measurements of parameters from the sensors of the compressor 10 and from the MRI cryostat 6. The measurement acquisition unit 102 receives the measurement of discharged gas temperature from the discharged gas temperature sensor 48, receives the measurement of compressor interior temperature from the compressor interior temperature sensor 50, receives the measurements of discharged cooling water flow rate and discharged cooling water temperature from the measuring unit 60, receives the measurement of high-pressure side pressure from the high-pressure side pressure detector 20, receives the measurements inside the MRI system (e.g., the pressure in the liquid helium bath **6*d* (internal helium pressure), the temperature of the superconducting coil 6*c*, etc.) via the network, receives the measurement of first-stage temperature from the first-stage temperature sensor 6*f* via the network, receives the measurement of the second-stage temperature from the second-stage temperature sensor 6*g* via the network, and receives the measurements of supplied current and supplied voltage from a power supply control unit (not shown) of the compressor 10. The measurement acquisition unit 102 stores the received measurements and the time of measurement in the log storage unit 114**, associating the measurements and the time with each other.

The status indicator calculation unit 104 calculates a status indicator (hereinafter, also referred to as "determination value") by applying the MT system to the measurements acquired by the measurement acquisition unit 102. A determination value represents "distance of displacement" (e.g., Mahalanobis distance), or a value indicating "distance of displacement", or a value calculated based on "distance of displacement". More specifically, the status indicator calculation unit 104 maps data stored in the standard data storage unit 112 in a unit space (e.g., creates a unit space database), and maps a set of measurements acquired by the measurement acquisition unit 102 in a signal space (e.g., creates a signal space database). The status indicator calculation unit 104 refers to the unit space and the signal space thus defined and calculates "distance of displacement" as a determination value. The status indicator calculation unit 104 stores the calculated determination value and the time of calculation in the log storage unit 114, associating the value and the time with each other.

In calculating the determination value, the status indicator calculation unit 104 may use all of the parameters shown in FIG. 5 or use at least two of the parameters. Insomuch as a plurality of parameters are used, choice of a parameter may be defined appropriately depending on the application.

The alert determination unit 106 compares the determination value calculated by the status indicator calculation unit 104 with a predetermined alert threshold value. If the former is lower than the latter, the alert determination unit 106 determines that an alert on a failure of the cooling system is unnecessary, and, if not, determines that an alert is necessary.

If the alert determination unit 106 determines that an alert is necessary, the alert communication unit 108 transmits an alert screen generation signal to the monitoring terminal 100 via the network. Upon receiving the alert screen generation signal, the monitoring terminal 100 displays a failure alert screen showing an alert on a failure of the cooling system on a display.

The standard data updating unit 110 acquires data for updating the standard data storage unit 112 via the network. The standard data updating unit 110 updates the standard data storage unit 112 with the acquired data for updating.

Figure 6:
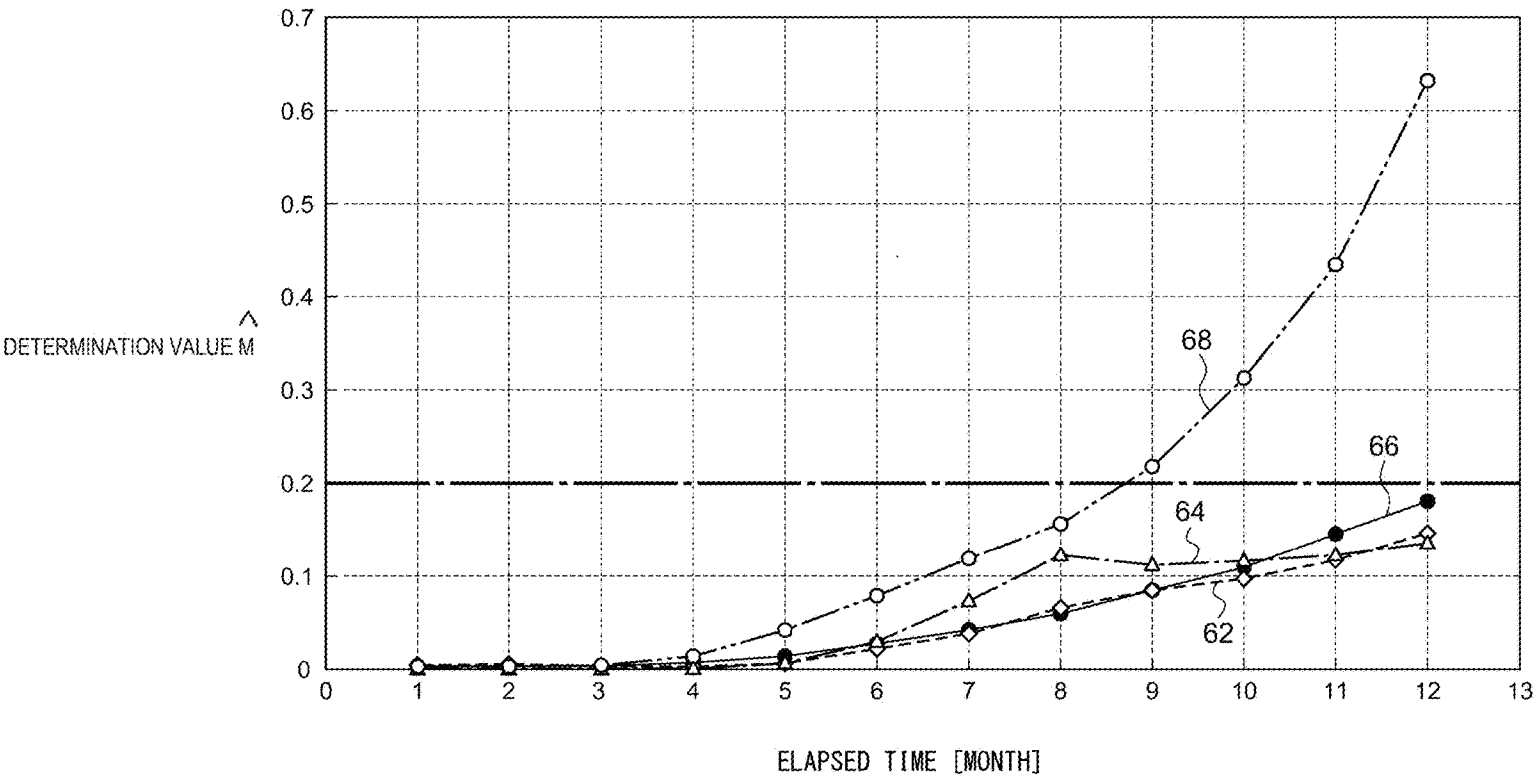
FIG. 6 shows timing of communicating an alert according to a calculated Mahalanobis distance.

FIG. 6 shows the timing of communicating an alert according to the calculated determination value. The horizontal axis of the graph of FIG. 6 represents twelve months of a year, and the vertical axis represents calculated determination values. Determination values calculated from the data of a year when no failures occurred in the cooling system throughout the year are indicated by plots 62, 64, and 66. Determination values calculated from the data of a year when the system abnormally stops in December due to a clog in cooling water piping of the water-cooled heat exchanger 12 of the compressor 10 are indicated by plots 68.

As shown in FIG. 6, the time-series data for determination values of a year when an abnormal stop occurs exhibits progressive divergence from the data for normal years. According to this embodiment, the alert threshold value in the alert determination unit 106 is set to 0.2 (the dashed-dotted line of FIG. 6). In this way, an alert on a failure is communicated to the operator about three months before an abnormal stop occurs.

FIG. 7 shows a typical failure alert screen 70. The failure alert screen 70 shows that the status of the cooling system approaches an abnormal stop in text and prompts the operator to perform maintenance of the cooling system.

Figure 8:
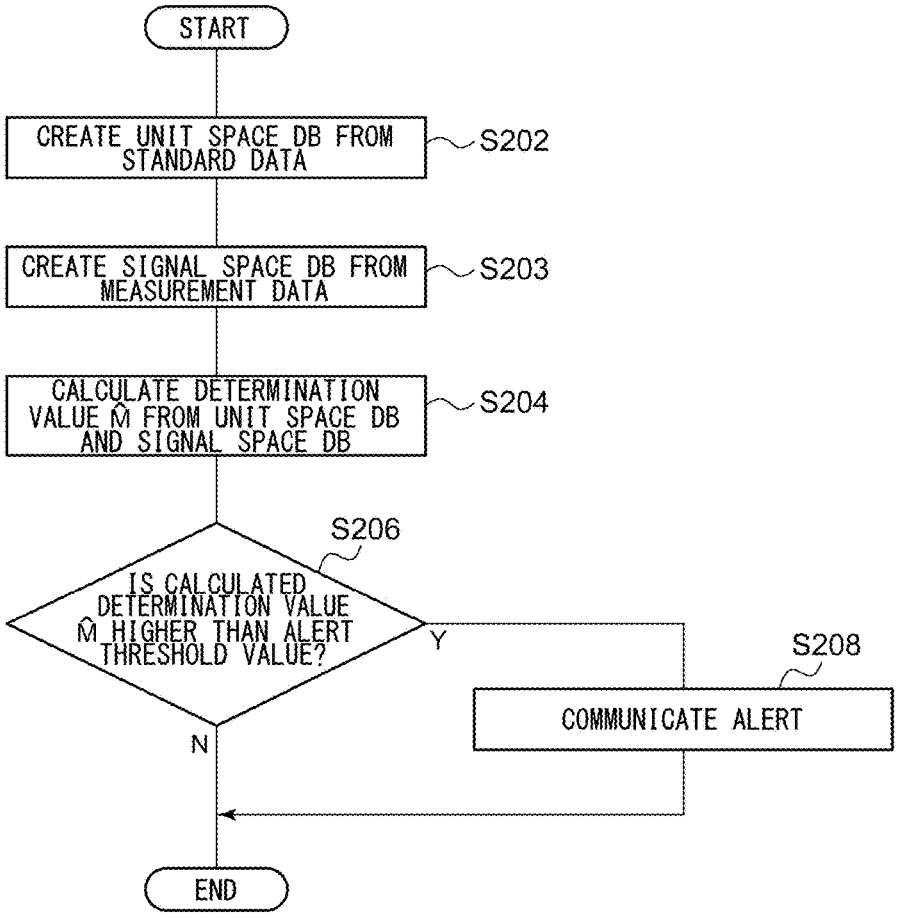
FIG. 8 is a flowchart showing a series of processes in the control unit of FIG. 2.

FIG. 8 is a flowchart showing a series of processes in the control unit 58. The status indicator calculation unit 104 creates a unit space database (also referred to as a unit space DB) from the standard data stored in the standard data storage unit 112 (S202). The status indicator calculation unit 104 creates a signal space database (also referred to as a signal space DB) from the measurement data acquired by the measurement acquisition unit 102 (S203). The status indicator calculation unit 104 calculates a determination value from the unit space DB and the signal space DB (S204).

The alert determination unit 106 determines whether the calculated determination value is higher than the alert threshold value (S206). If the determination value is equal to or lower than the alert threshold value (N in S206), the process is terminated. If the determination value is higher than the alert threshold value (Y in S206), the alert communication unit 108 performs the process of communicating an alert on a failure to the operator (S208).

According to the cooling system of the embodiment, measurements of a plurality of different parameters representing the status of the cooling system are subject to multivariate analysis and prediction of a failure of the cooling system and communication of an alert are performed based on the result of analysis. Accordingly, the precision of prediction can be improved as compared to failure prediction based on a single variable. In multivariate analysis, correlation between parameters can be taken into consideration so that the likelihood of wrong detection of an abnormality can be reduced.

According to the cooling system of the embodiment, an alert can be communicated before an abnormal stop of the cooling system occurs. Thus, the operator can build and run a maintenance plan to stop the MRI system 2 before an abnormal stop occurs, resulting in less trouble in the operator's activities.

In the cooling system according to the embodiment, the MT system is employed as a means of multivariate analysis. Correlation between the plurality of different parameters representing the status of the cooling system including the GM refrigerator 4 and the compressor 10 is relatively high. For example, as the temperature of cooling water flowing into the compressor 10 increases, the discharged cooling water temperature and the discharged gas temperature could also increase. This could lower the cooling performance of the GM refrigerator 4 and increase the first-stage temperature and the internal helium pressure. By employing the MT system capable of properly allowing for correlation between parameters to be taken into account as a means of multivariate analysis, generation of an abrupt abnormality of the cooling system can be properly predicted and the risk of wrong detection can be reduced.

Described above are the cooling system according to the embodiment and the MRI system 2 that uses the system. The embodiment is intended to be illustrative only and it will be obvious to those skilled in the art that various modifications to constituting elements and processes could be developed and that such modifications are also within the scope of the present invention.

The embodiment is described as using the GM refrigerator 4 by way of example. However, the type of refrigerator is non-limiting. For example, the refrigerator may be a pulse tube refrigerator of GM type or Stirling type, or a Stirling refrigerator, or a Solvay refrigerator.

The cooling system according to the embodiment is described as being used in the MRI system 2. However, the application of the cooling system is non-limiting. For example, the cooling system may be used as a cooling means or a liquefying means in a superconducting magnet, a cryopump, an X-ray detector, an infrared sensor, a quantum photon detector, a semiconductor detector, a dilution refrigerator, an He3 refrigerator, an adiabatic demagnetization refrigerator, a helium liquefier, a cryostat, etc.

The standard data storage unit 112 according to the embodiment is described as being updated by data received externally. However, the manner of updating the standard data storage unit 112 is non-limiting. For example, the control unit may update the standard data storage unit by learning. In this case, it is possible to create a unit space specifically suited to the environment in which the cooling system is used. Therefore, the precision of failure prediction can be improved as compared to the case of updating with external data. However, the precision of failure prediction will be lowered if the environment changes as a result of the cooling system being transferred from the MRI system 2 to another system. In other words, the above-mentioned variation is poor in versatility.

The superconducting coil 6*c* in the MRI system 2 according to the embodiment is described as being maintained at a low temperature by immersing the superconducting coil 6*c* in liquid helium. However, the manner of maintaining a low temperature is non-limiting. For example, the superconducting coil may be maintained at a low temperature by directly placing the superconducting coil in direct contact with the second cooling stage of the GM refrigerator (see FIG. 9). In this case, the control unit 58 may acquire the temperature of the superconducting coil instead of the internal helium pressure and employ the temperature as one of the parameters representing the status of the MRI system.

The cooling system according to the embodiment is described as being applied to the MRI system 2. However, the application of the cooling system is non-limiting. The cooling system according to the embodiment can be applied to arbitrary superconducting equipment such as a superconducting electromagnet system.

Figure 9:
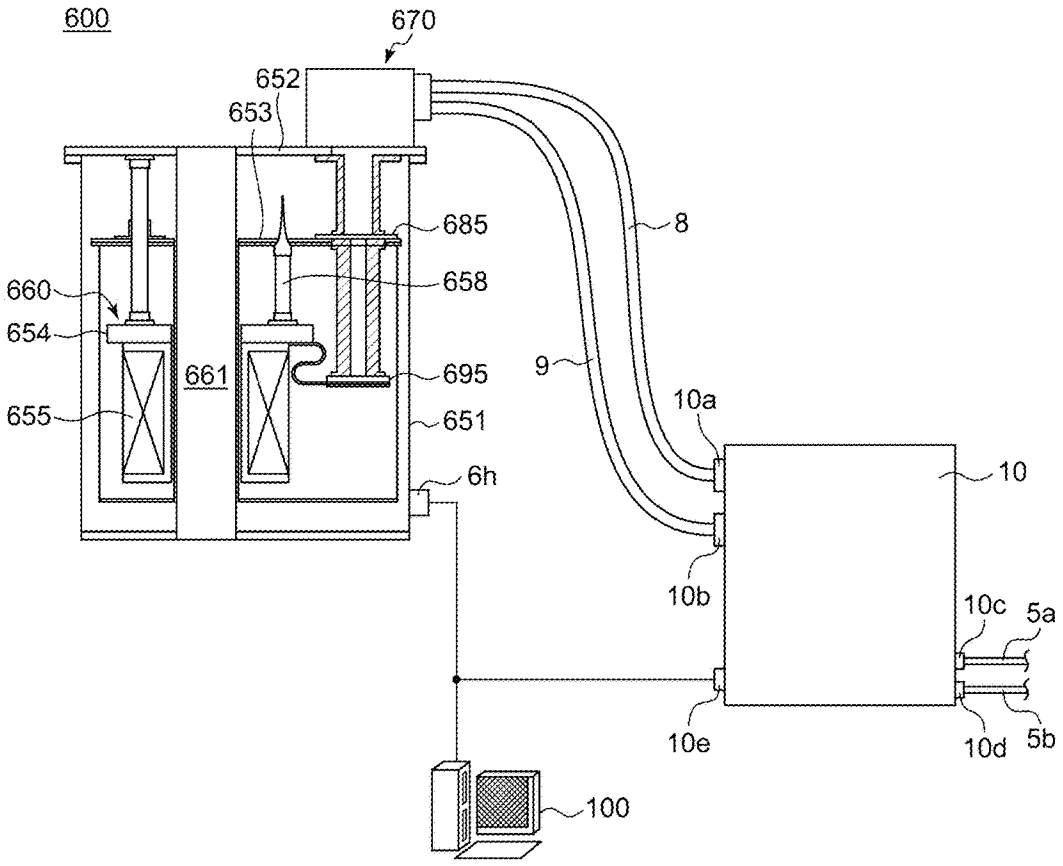
FIG. 9 is a schematic diagram illustrating a configuration of a superconducting magnet system provided with a cooling system according to an embodiment.

FIG. 9 is a schematic diagram illustrating the configuration of a superconducting magnet system 600 provided with the cooling system according to the embodiment. As in the case of the embodiment illustrated in FIG. 1, the cooling system of FIG. 9 is provided with a GM refrigerator 670, a compressor 10, and a monitoring terminal 100. The GM refrigerator 670 is provided to cool the superconducting magnet system 600. The compressor 10 is coupled to the GM refrigerator 670 using two flexible pipes 8, 9. A first communication port 6*h* of the superconducting magnet system 600, a second communication port 10*e* of the compressor 10, and a communication port of the monitoring terminal 100 are connected to each other via a wire or wireless network.

The superconducting magnet system 600 includes a vacuum chamber 651, a GM refrigerator 670, a superconducting magnet 660 for applying a magnetic field to a strong magnetic field space 661. The GM refrigerator 670 is mounted on a top plate 652 placed in the vacuum chamber 651 such that the cold head of the GM refrigerator 670 hangs from the top plate 652. The GM refrigerator 670 may be a two-stage GM refrigerator. In the example shown in FIG. 9, the GM refrigerator 670 has a configuration similar to that of the GM refrigerator 4 shown in FIG. 1. Therefore, a detailed description of the GM refrigerator 670 will be omitted.

A first cooling stage 685 of the GM refrigerator 670 is thermally and mechanically coupled by a thermal shield plate 653 to an oxide superconducting current lead 658 for supplying an electric current to the superconducting coil 655 of the superconducting magnet 660. A second cooling stage 695 of the GM refrigerator 670 is thermally and mechanically coupled to a coil cooling stage 654 of the superconducting coil 655. The coil cooling stage 654 is placed in contact with the superconducting coil 655. The superconducting coil 655 is cooled by the cold from the second cooling stage 695 below the superconducting critical temperature.

In an embodiment, the cooling system may be configured to perform monitoring and/or diagnosis of a leak of the operating gas (e.g., helium gas) and/or the heat exchanger in the compressor in addition to the monitoring and/or diagnosis using the MT system, as described below. Alternatively, the cooling system may be configured to perform monitoring and/or diagnosis of the operating gas leakage and/or the heat exchanger instead of the monitoring and/or diagnosis using the MT system (i.e., only the monitoring and/or diagnosis of the operating gas leakage and/or the heat exchanger may be performed).

The control unit 58 may be configured to monitor the leak of the operating gas based on the high-pressure side pressure and a low-pressure side pressure of the refrigerator (e.g., GM refrigerator 4) or the compressor (e.g., compressor 10). More specifically, the control unit 58 may determine whether the leak occurs or not based on three pressure parameters including a pressure difference between the high-pressure side pressure and the low-pressure side pressure, the high-pressure side pressure, and the low-pressure side pressure.

The cooling system may comprise a low-pressure side pressure detector in addition to the high-pressure side pressure detector 20. The low-pressure side pressure detector is configured to detect the low-pressure side pressure (e.g., a pressure of the operating gas in the low-pressure side pipe 14) and to report the pressure to the control unit 58. Alternatively, the cooling system may comprise a pressure difference detector that detects the pressure difference between the high-pressure side pressure and the low-pressure side pressure and that reports it to the control unit 58 instead of either the high-pressure side pressure detector 20 or the low-pressure side pressure detector.

The control unit 58 may determine that the gas leak occurs when any one of the following two phenomena is detected.

Phenomenon 1. The pressure difference between the high-pressure side pressure and the low-pressure side pressure is reduced, the high-pressure side pressure is reduced, and the low-pressure side pressure is reduced. Such a substantially simultaneous drop in the three pressure parameters allows a determination that the leak occurs.

Phenomenon 2. The pressure difference between the high-pressure side pressure and the low-pressure side pressure is increased, the high-pressure side pressure is reduced, and the low-pressure side pressure is reduced. When these pressure changes are substantially simultaneously detected, a determination that the leak occurs at a position in the low-pressure gas line is allowed.

A phenomenon similar to Phenomenon 1 may occur not only during a steady cooling operation of the refrigerator (e.g., a continuous cooling operation for maintaining a given cryogenic temperature) but also during a cool-down operation (e.g., a rapid cooling operation from a room temperature to a cooling temperature of the steady operation). Accordingly, the control unit 58 may determine that the gas leak occurs when either Phenomenon 1 or Phenomenon 2 is detected during the steady cooling operation.

A pressure threshold for detecting Phenomenon 1 and/or Phenomenon 2 may be set to a value of about 0.5 MPa or greater. For example, the control unit 58 may detect Phenomenon 1 when a respective amount of reduction in each of the three pressure parameters substantially simultaneously exceeds the threshold.

The control unit 58 may generate an alert that the operating gas leakage occurs when the control unit 58 determines so.

The control unit 58 may monitor the heat-exchange efficiency of the heat exchanger in the compressor (e.g., oil heat exchanger 26 or gas heat exchanger 27) based on a temperature difference between a temperature of a cooling fluid and a temperature of a cooled fluid in the heat exchanger. The cooling system may comprises a temperature sensor 74 that measures the temperature of the cooling fluid and another temperature sensor 72 that measures the temperature of the cooled fluid. The control unit 58 may determine that the heat-exchange efficiency is degraded when the measured temperature difference exceeds a temperature threshold, and may generate an alert on it, if required.

For example, the control unit 58 may determine whether the heat-exchange efficiency is degraded or not based on a temperature difference between an oil outlet temperature and a cooling water inlet temperature. The compressor 10 may comprise an oil temperature sensor 72 and a cooling water temperature sensor 74. The oil temperature sensor 72 may be arranged in a part of the oil cooling pipe 33 between an oil outlet from the compression capsule 11 and an oil inlet into the oil heat exchanger 26. The cooling water temperature sensor 74 may be arranged in the first pipe 42 coupling the cooling water inlet port 10*c* to the cooling water receiving port 12A. The temperature threshold may be in a range from about 20 degrees Celsius to about 30 degrees Celsius.

It should be appreciated that the degradation of the heat-exchange efficiency may be caused by the quality (e.g., a poor quality) of the cooling water. A portion of the cooling water may stay in the heat exchanger to form a gel-like material that may prevent a part of the heat exchange depending on the size of the material. A grown-up gel-like material may restrict a flow of the cooling water. Further, the flow of the cooling water may be blocked when the gel-like material closes the conduit. A solid material, which may be referred to as scale, may be attached on an internal surface of the conduit, alternative to or in addition to the gel-like material. Moreover, a thin film of the gel-like material may be formed on a heat exchange surface in contact with the cooling water and may prevent a part of the heat exchange depending on the thickness of the film.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-169405, filed on Aug. 19, 2013, the entire content of which is incorporated herein by reference.

What is claimed is:

1. A monitoring method for a cooling system, wherein the cooling system comprises:

a refrigerator configured to use gas; and a compressor configured to supply the gas to the refrigerator and to generate compression heat by compressing the gas returned from the refrigerator, wherein the compressor comprises a water-cooled heat exchanger that is configured to:

(i) flow cooling water from a cooling water receiving port through a cooling water pipe, (ii) transfer the compression heat from the oil flowing in an oil cooling pipe to the cooling water flowing in the cooling water pipe in a manner that heats the cooling water flowing in the cooling water pipe, and (iii) discharge the cooling water heated by the compression heat from the cooling water pipe through a cooling water discharge port to outside the compressor, the method comprising:

acquiring, by using a cooling water temperature sensor, first measurements that include a cooling water temperature of the cooling water discharged from the cooling water discharge port and, by using an oil temperature sensor, second measurements that include at least one parameter representing a status of the refrigerator, or the compressor, or both;

conducting multivariate analysis of the acquired first and second measurements;

determining whether an alert on a failure should be communicated to a user, based on a result of the multivariate analysis; and alerting the user to the failure when a determination has been made that the user would be notified.

2. The monitoring method according to claim 1, wherein the water-cooled heat exchanger comprises an oil heat exchanger configured to perform heat exchange between an oil cooling pipe through which oil flows and a cooling water pipe through which the cooling water flows, the compression heat is transferred from the oil to the cooling water by the heat exchange in the oil heat exchanger;

wherein the at least one parameter includes an oil temperature of the oil flowing through the oil cooling pipe.

3. The monitoring method according to claim 1, wherein the at least one parameter includes at least two of a temperature of the compressor, a pressure of the gas, a flow rate of the cooling water of the compressor, a temperature of the refrigerator, and an electrical parameter indicating power consumption of the compressor.

4. The monitoring method according to claim 1, wherein the cooling system is used to cool a coil of a superconducting magnet system, and the at least one parameter includes a parameter representing a status of the superconducting magnet system.

5. The monitoring method according to claim 4, wherein the parameter representing the status of the superconducting magnet system includes at least one of a pressure in a liquid helium bath around the coil of the superconducting magnet system, a temperature of the coil, and a temperature of a shield for the liquid helium bath.

6. The monitoring method according to claim 1, wherein the multivariate analysis is a Mahalanobis-Taguchi (MT) system.

7. The monitoring method according to claim 1, wherein the conducting comprises calculating a determination value as a result of the multivariate analysis of the acquired first and second measurements, the determining comprises comparing the determination value with a predetermined alert threshold value, the alerting comprises alerting the user to the failure if the determination value exceeds the predetermined alert threshold value.

8. The monitoring method according to claim 1, further comprising:

acquiring, by another cooling water temperature sensor, a cooling water temperature of the cooling water received from the cooling water receiving port, wherein the first measurements include the cooling water temperature of the cooling water received from the cooling water receiving port.

9. A cooling system comprising:

a refrigerator that uses gas;

a compressor configured to supply the gas to the refrigerator and to generate compression heat by compressing the gas returned from the refrigerator, the compressor comprising a water-cooled heat exchanger that is configured to:

(i) flow cooling water from a cooling water receiving port through a cooling water pipe, (ii) transfer the compression heat from oil flowing in an oil cooling pipe to the cooling water flowing in the cooling water pipe in a manner that heats the cooling water flowing in the cooling water pipe, and (iii) discharge the cooling water heated by the compression heat from the cooling water pipe through a cooling water discharge port to outside the compressor, a cooling water temperature sensor configured to measure a cooling water temperature of the cooling water discharged from the cooling water discharge port;

a further cooling water temperature sensor configured to measure a cooling water temperature of the cooling water received from the cooling water receiving port, and a control unit that comprises:

(a) an analysis unit that conducts multivariate analysis of measurements measured by the cooling water temperature sensor and the further cooling water temperature sensor;

(b) an alert determination unit that determines whether an alert on a failure should be communicated to a user, based on a result of the multivariate analysis; and (c) an alert communication unit that alerts the user to the failure when a determination has been made that the user should be notified.

* * * * *